US011261616B2

(12) United States Patent
Abdus-Samad

(10) Patent No.: US 11,261,616 B2
(45) Date of Patent: Mar. 1, 2022

(54) MODULAR FENCE SYSTEM

(71) Applicant: Khalid Abdus-Samad, Houston, TX (US)

(72) Inventor: Khalid Abdus-Samad, Houston, TX (US)

( * ) Notice: Subject to any disclaimer, the term of this patent is extended or adjusted under 35 U.S.C. 154(b) by 708 days.

(21) Appl. No.: 16/007,979

(22) Filed: Jun. 13, 2018

(65) Prior Publication Data

US 2019/0003202 A1 Jan. 3, 2019

Related U.S. Application Data

(60) Provisional application No. 62/525,958, filed on Jun. 28, 2017.

(51) Int. Cl.
*E04H 17/14* (2006.01)

(52) U.S. Cl.
CPC ..... *E04H 17/143* (2013.01); *E04H 17/1447* (2021.01); *E04H 17/1448* (2021.01)

(58) Field of Classification Search
CPC ..... E04H 17/143; E04H 17/1439; E04H 17/1447; E04H 17/1448
See application file for complete search history.

(56) References Cited

U.S. PATENT DOCUMENTS 5,611,523 A * 3/1997 Parisien ..... E04H 17/1447 256/68
7,025,335 B2 4/2006 Zhu
7,651,073 B1 6/2010 Gibbs
8,413,332 B2 * 4/2013 Duffy ..... E04H 17/1447 29/897.31
9,027,909 B1 * 5/2015 Peyton ..... E04H 17/1439 256/67
9,371,666 B2 * 6/2016 Allen ..... E04H 17/1447
9,404,283 B1 * 8/2016 Lo ..... E04H 17/1439
9,574,370 B2 * 2/2017 Presti ..... E04H 17/1439
10,648,194 B2 * 5/2020 Lo ..... E04H 17/1439
2003/0132426 A1 * 7/2003 Kang ..... E04H 17/1447 256/22
2005/0045863 A1 3/2005 MacKay
2005/0194581 A1 * 9/2005 Chesnutt, Sr. ..... E04H 17/1417 256/22
2005/0236611 A1 * 10/2005 Vereide ..... E04F 11/1834 256/59
2005/0242335 A1 11/2005 Bun et al.
2006/0214149 A1 * 9/2006 Hung ..... E04H 17/1447 256/22
2013/0264532 A1 * 10/2013 Goodman ..... E04H 17/1439 256/65.08
2014/0203230 A1 7/2014 Forbis
2019/0330878 A1 * 10/2019 Presti ..... E04H 17/143

* cited by examiner

*Primary Examiner* — Matthew R McMahon
(74) *Attorney, Agent, or Firm* — Patrick Mixon

(57) ABSTRACT

A modular fence system is disclosed herein. The modular fence system includes a frame having a fence post bracing bar, an upper locking bar, a lower locking bar, an upper stationary bar, a lower stationary bar, wherein fence boards may be coupled and uncoupled from the frame when the upper and lower locking bars are in the open position. The frame may be utilized with removable fence boards or a lattice style fence. The modular fence system is useful for simple installment of aesthetic and removable fence arrangements.

16 Claims, 15 Drawing Sheets

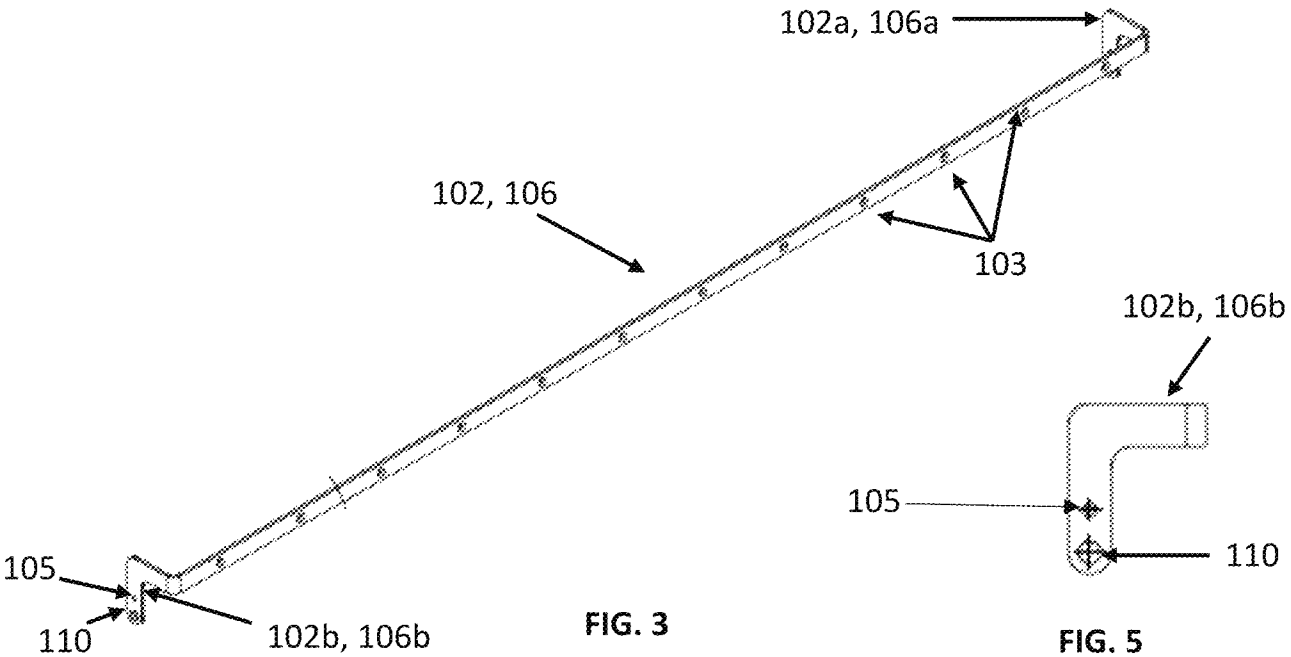
FIG. 3
FIG. 5
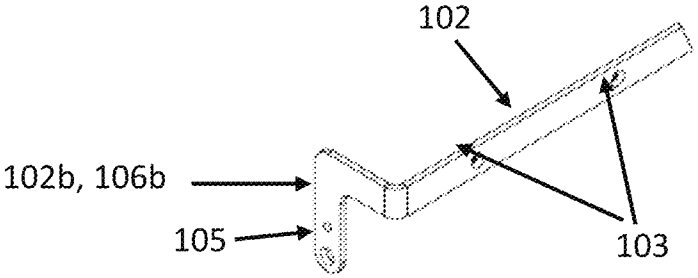
FIG. 4

MODULAR FENCE SYSTEM

RELATED APPLICATIONS

The present application claims benefit to and priority from U.S. Provisional Patent Application No. 62/525,958, filed Jun. 28, 2017, titled "Modular Fence Systems," which is commonly invented and owned by the Applicant.

BACKGROUND OF THE INVENTION

1. Field of the Invention

The present invention relates generally to the field of fences and more specifically relates to modular fences.

2. Description of the Related Art

A fence is a structure that encloses an area, typically outdoors, and is usually constructed from posts that are connected by boards, wire, rails and/or netting. A fence may not have a solid foundation along its whole length. Many fences can be difficult to install, particularly for those with little or no experience in fences. Also, fence building is time consuming, and in many cases, may require expensive, specialized tools.

To facilitate fence building, some fences are often constructed in interchangeable fence subparts. Such fences are called modular fences. With modular fences, the fence subparts are assembled to create an enclosure.

Modular fences are also popular amongst consumers because of the ease at which they can be repaired. For example, when one subpart ('module") of a modular fence is damaged, the fence owner need only replace the damaged module, while the remainder of the fence remains intact. Not only is replacing the entire module easier for the consumer than replacing the entire fence, replacing the module is also less expensive than replacing the entire fence.

However, conventional modular fences are lacking in that the user must replace the entire module and cannot easily repair the module itself. A user who is able to repair the module, would not have to replace the module entire, thereby further saving the user money. Further still, conventional modular fences are lacking in that they often do not allow the user to exchange the fence's look or style.

Therefore, what is needed is a modular fence system wherein the modules are easy to repair. Such a system would also provide for the easy replacement of parts allowing the user to change the modular fence's appearance. Thus, a need exists for a reliable modular fence system that provides for convenient installation and readily available style change, and to avoid the above-mentioned problems.

BRIEF SUMMARY OF THE INVENTION

The modular fence system of the present invention provides advantageously not found in the prior art. The present invention is superior to other systems in that it effectively allows for convenient installation, repairs, and style changes to a modular fence.

Preferably, the modular fence system may include a frame having a fence post bracing bar, an upper locking bar, a lower locking bar, an upper stationary bar, a lower stationary bar, a first backing-bar, and a second backing-bar. Removable fence boards may be utilized with the frame. Fasteners such as rivets, screws, etc., may be used to allow the upper locking bar and the lower locking bar to rotate to open position or close position for removing or adding fence boards. A coupling peg bar may be used in conjunction with the locking bars to secure the fence boards in place. The coupling peg bar may include a plurality of pegs, which may be inserted into apertures in the fence boards for installation. A variety offence styles may include but not limited to wooden boarded and lattice.

In one aspect the invention includes a modular fence system comprising:

a. an elongated fence board, the elongated fence board having an upper portion, the elongated fence board including a mating coupling hole in an upper portion of the elongated fence board;
b. a coupling peg bar, the coupling peg bar having a first side, the coupling bar having a mating peg on the first side of the coupling peg board, the mating peg configured to mate with the mating coupling hole in the upper portion of the elongated fence board;
c. a first side bar, the first side bar having a first end; and
d. a locking bar, the locking bar having a first end, wherein the first end of the locking bar is rotatably affixed to the first end of the first side bar, and wherein the locking bar immovably locks the upper portion of the elongated fence bar into abutment with the coupling peg bar when the locking bar is rotated in a closed position.

In another aspect, the invention discloses a modular fence system comprising:

a. a stationary bar, the stationary bar having a first end and a second end,
b. a first side bar, the first side bar having a first end, and wherein the first end of the stationary bar is affixed to the first end of the first side bar,
c. a coupling peg bar, the coupling peg bar having a first side and a second side, the coupling bar having a mating peg on the first side of the coupling peg board; wherein the stationary bar is configured to mate with the second side of the coupling peg bar; and a locking bar, the locking bar having a first end, wherein the first end of the locking bar is rotatably affixed to the first end of the first side bar.

A method of using the modular fence systems of the invention is also taught herein. The method includes placing the fence post bracing bar into a ground surface with two fence post holes, inputting the fence boards into the frame, and locking the lower locking bar and the upper locking bar to the fence boards. The method may optionally include interlocking another modular fence arrangements to the frame. The present disclosure may be advantageous in that the modular fencing system may be convenient to install and provide aesthetic and removable features.

The present invention is described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The figures which accompany the written portion of this specification illustrate embodiments and method(s) of use for the present invention, modular fence systems, constructed and operative according to the teachings of the present invention.

FIG. 3 is a perspective view of a locking bar according to an embodiment of the present invention.

FIG. 4 is a perspective view of a portion of the locking bar according to an embodiment of the present invention.

FIG. 5 is a side view of a locking bar according to an embodiment of the present invention.

The various embodiments of the present invention will hereinafter be described in conjunction with the appended drawings, wherein like designations denote like elements.

DETAILED DESCRIPTION

The present invention is directed to a modular fence system. More particularly, the invention relates to a modular fence with replaceable fence boards. In various embodiments, the invention teaches a modular fence wherein the fence boards are replaceable on both sides of the fence.

In one embodiment of the present invention, modular fence systems may comprise a frame having a fence post bracing bar, an upper locking bar, a lower locking bar, an upper stationary bar, a lower stationary bar, a first backing-bar, and a second backing-bar. Removable fence boards (also called "pickets," herein) may be utilized with the frame. The fence boards may be wooden. The frame may be of a desired sturdy material (i.e. metal). A plurality of coupling pegs may extend along a coupling peg bar which may be matched to the lower locking bar or the upper locking bar to secure the pickets to the modular fence system frame. For example, the fence boards may include mating coupling holes formed on a top portion and a bottom portion of the fence boards. The plurality of coupling pegs may be inserted into mating coupling holes formed in the fence boards for installation, and a fastener may be inserted in the mating coupling holes to affix to the coupling peg bar.

The fence boards are interchangeable in that the user need only remove the fastener, unlock the fence boards by lowering (e.g., the locking bar) the locking bar, uncouple the fence boards from the coupling peg bar, and exchange one or more fence boards with a more desirable board selection. In this way, pickets may be matched and mated to the removable pickets by inserting the coupling pegs into the pickets mating coupling holes. Alternatively, the user may wish to exchange the fence boards with fence boards having a different decorative quality. The fence boards may be held in place by the lower locking bar and the upper locking bar which respectively place holding pressure on a lower portion and upper portion of the fence boards. The elements and operation of the modular fence according to the present invention will be described more fully below.

Figure 1:
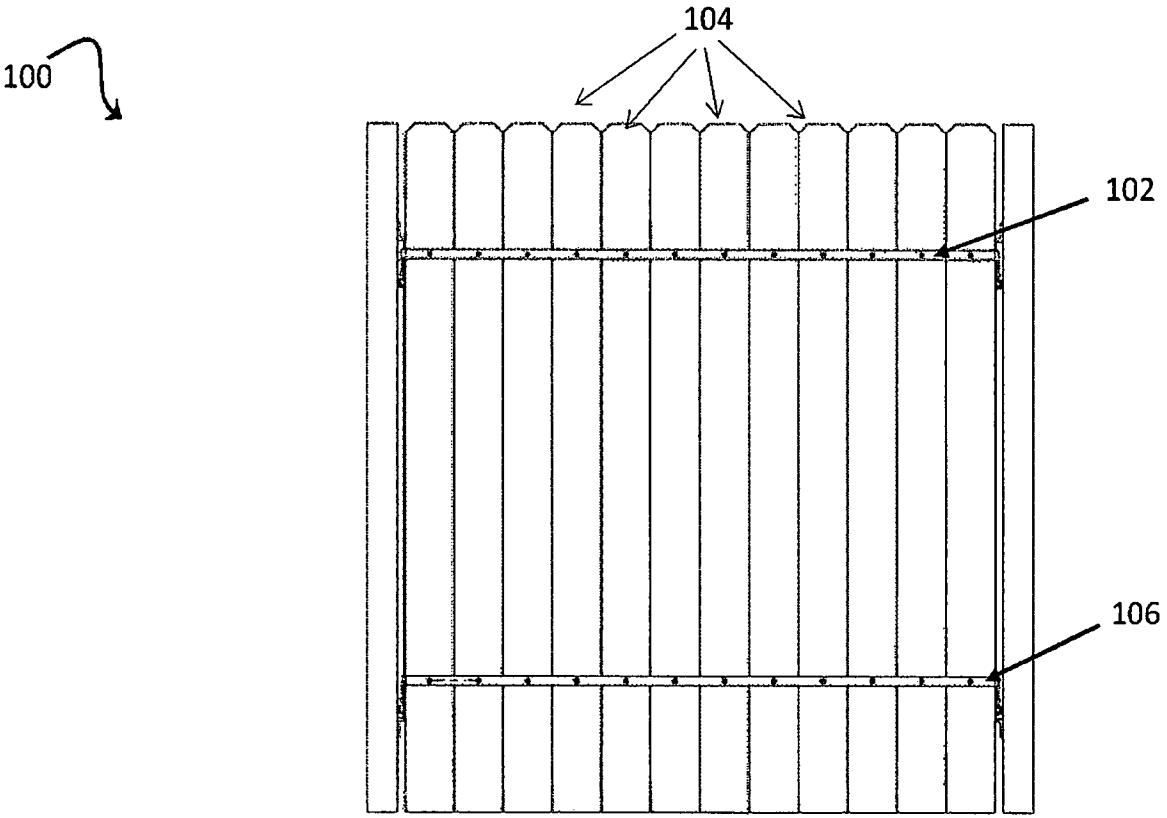
FIG. 1 is a frontal view of a modular fence system showing a single-sided fence according to an embodiment of the present invention.
Figure 2:
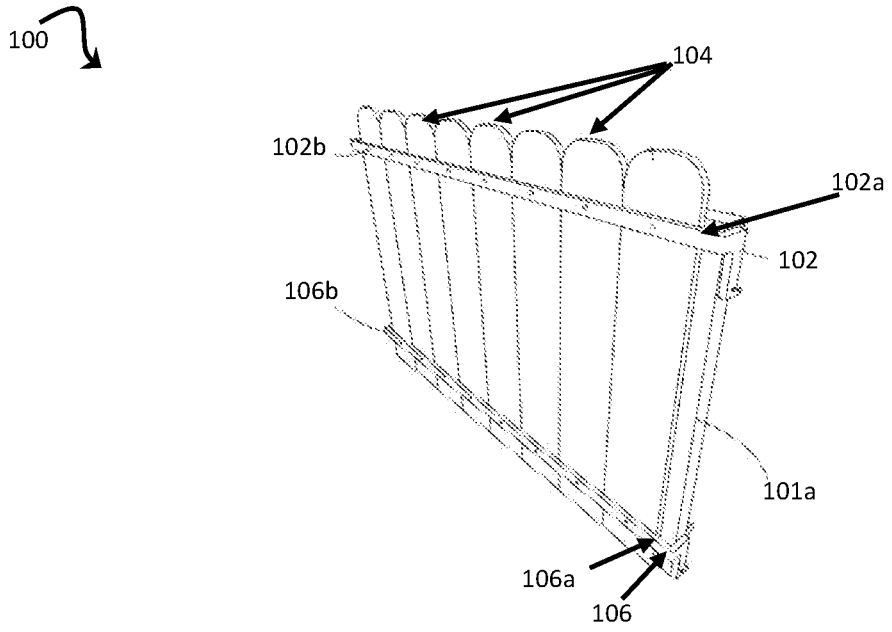
FIG. 2 is a perspective view of a modular fence system showing a single-sided fence according to an embodiment of the present invention.

Referring now to the drawings, FIG. 1 depicts a frontal view of modular fence system 100 showing a single-sided fence arrangement according to the present invention. FIG. 2 depicts a prospective view of modular fence system 100 according to various embodiments of the invention. As shown in FIGS. 1 and 2, modular fence system 100 may comprise multiple elongated fence boards 104 arranged such that the length (e.g., the longer side of the fence board 104, relative to the shorter side of fence board 104) of each of fence boards 104 are adjacent to the length of each of the other fence boards 104. In operation, fence boards 104 may be position vertically such that the fence boards 104 are placed upright and perpendicular to the horizon. That is, fence boards 104 may be arrange side-by-side in similar manner as with conventional fence pickets.

In preferred embodiments, fence boards 104 may be held immovably fixed by upper locking bar 102 and lower locking bar 106. Upper locking bar 102 may be used to removably affixing an upper portion of fence boards 104 to a first coupling bar. Similarly, lower locking bar 106 may be used to removably affix a lower portion of fence boards 104 to a second coupling bar.

FIGS. 3-5 depict an exemplary embodiment of a locking bar 102, 106 in accordance with the present invention. In particular, FIG. 3 is a perspective view of a locking bar according to an embodiment of the present invention. FIG. 4 is a perspective view of a portion of the locking bar according to an embodiment of the present invention. FIG. 5 is a side view of a locking bar according to an embodiment of the present invention. As shown, the locking bar 102, 106 may be elongated in shape. Locking bar 102, 106 may include a first end 102*a*, 106*a*. First end 102*a*, 106*a* may be configured to be an angular in shape. In a preferred embodiment, the angle at which first end 102*a*, 106*a* is shaped is chosen to increase the force exerted by the elongated portion of the longing bar 102, 106 on the lateral surfaces of fence boards 104 for securing the fence boards 104 to coupling peg bar 132. In one particular embodiment, the angle of first end 102*a*, 106*a* may be substantially 90 degrees. In another preferred embodiment, locking bar 102, 106 may have a second end 102*b*, 106*b* of similar construction as described with first end 102*a*, 106*a* of locking bar 102, 106. In yet another embodiment of the invention, module fence system 100 may include only one locking bar, or multiple locking bars. In such an instance, the additional locking bars may be constructed as described with respect to locking bar 102, 106.

In one exemplary embodiment of the present invention, locking bar 102, 106 may include coupling apertures 103 for use in securing fence boards 104 to a coupling peg bar 132, shown for example in FIG. 3. For example, and as described more fully below, fasteners may be inserted into fence boards 104 for removably affixed fence boards 104 to coupling peg bar 132. In other embodiments of the invention, the fastener may be first inserted into the locking bar 102 coupling apertures 103 prior to removably affix the fasteners to coupling peg bar 132. In this way, the fasteners may abut against locking bar 102 which abuts against fence boards 104, thereby holding locking bar 102, 106 in place and further securing fence boards 104. The fasteners may be any conventional fasteners such as a screw.

An upper locking bar 102 may extend across an upper portion of fence boards 104 for locking an upper portion of fence boards 104 in a fixed position. Similarly, and the lower locking bar 106 may extend horizontally across a bottom portion of fence boards 104 for locking a lower portion of fence boards 104 in a fixed position.

By "upper portion," what may be meant is that portion of the fence boards 104 that extends from the midpoint of the fence boards 104 toward the horizontal when the fence board is installed in modular fence system 100. When installed, fence boards 104 are positioned perpendicular to the horizon. An upper portion of fence boards 104 may be measured from the middle of the length of fence boards 104 toward the horizon. In alternate embodiments, "upper portion" may mean that locking bar 102 extends perpendicular to a upper one-half of elongated fence boards 104. In an even further alternate embodiment, "upper portion" may mean that locking bar 102 extends perpendicular to an upper one-quarter of fence boards 104.

Similarly, by "lower portion," what may be meant is that portion of the fence boards 104 that extends from the midpoint of the fence boards 104 away from the horizontal when the fence board is installed in modular fence system 100. A lower portion of fence boards 104 may be measured from the middle of the length of fence boards 104 way from the horizon. In alternate embodiments, lower portion may mean that locking bar 102 extends perpendicular to a lower one-half of elongated fence boards 104. In an even further alternate embodiment, "lower portion" may mean that locking bar 102 extends perpendicular to a lower one-quarter of fence boards 104.

Figure 6:
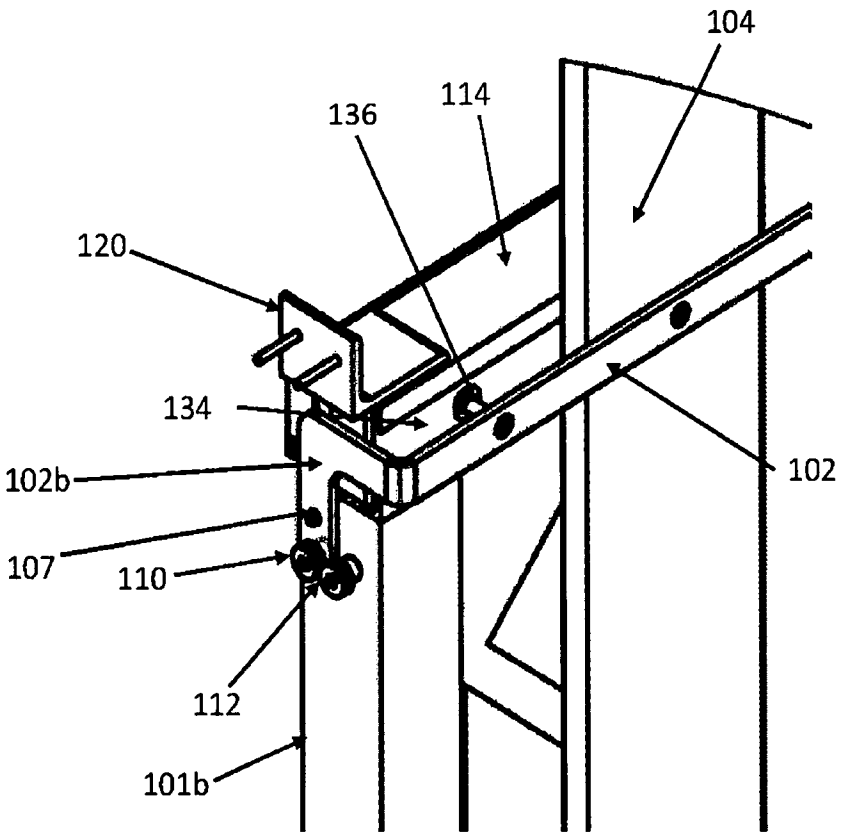
FIG. 6 is a perspective view of a modular fence system according to an embodiment of the present invention depicting a locking bar in the closed position.
Figure 7:
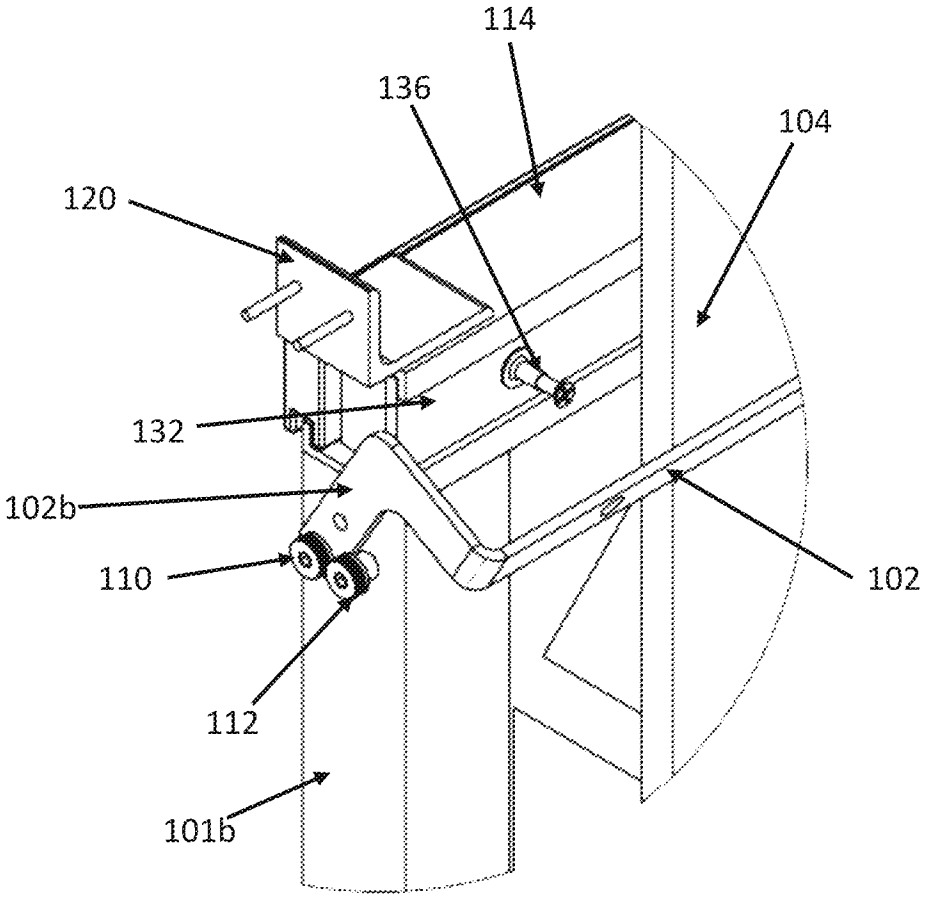
FIG. 7 is a perspective view of a modular fence system according to an embodiment of the present invention depicting a locking bar in the open position.

With reference to FIGS. 6 and 7, locking bars 102 and 106 may be rotatably affixed to vertically positioned side bars 101*a*, 101*b*. Particularly, FIG. 6 is a perspective view of a modular fence system according to an embodiment of the present invention depicting a locking bar in the closed position. FIG. 7 is a perspective view of a modular fence system according to an embodiment of the present invention depicting a locking bar in the open position. For example, a first end 102*b* of upper locking bar 102 may be rotatably affixed to a first end of a first side bar 101*b*. Similarly, a second end 102*a* of upper locking 102 bar may be rotatably affixed to a first end of a second side bar 101*a*. Additionally, a first end 106*a* of lower locking bar 106 may be rotatably affixed to a second end of a first side bar 101*a*. A second end 106*b* of upper locking 106 bar may be rotatably affixed to a second end of a second side bar 101*b*. As described herein, the means for affixing the locking bars to the side bars may be similar for each locking bar side bar combination discussed.

As shown, side bars 101*a* and 101*b* may be affixed to upper stationary bar 114 and a lower stationary bar 116, such that the side bars and the stationary bars substantially form a rectangle. That is, a first end and a second end of upper stationary bar 114 may be perpendicular to, and immovably affixed to a first end of side bars 101*a* and 101*b*, respectively. Similarly, a first end and a second end of lower stationary bar 116 may also be perpendicular to, and immovably affixed to a second end of side bars 101*a* and 101*b*, respectively.

As used herein, the "first end" and "second end" of the bars are substantially in the same plain and lie substantially opposite of each other. That is, the first end is on the distal end comparative to the second end. Moreover, as mentioned, the locking bars 102, 106 are "rotatably affixed" to the side bars 101*a*, 101*b*. More particularly, the means for rotatably fixing the locking bars 102, 106 (i.e., "rotatably affixing means 110") may be any means which permits the locking bars of the present invention to angularly rotate relative to the vertically positioned side bars. Rotatably affixing means 110 may be, for example, a rivet, a stud, a pole, a screw or the like, around which locking bars 102, 106 may rotate. In some cases, the rotation may be a substantially frictionless. In another exemplary embodiment, the rotation may be measured, such as, for example, where the rotation may include means for halting the rotation at a desired location along the angular rotation.

Furthermore, various elements of the invention are described as "mating" one with another. Mating as used herein may mean that one element of the invention is configured to fit snuggly together with the other element Mating may also mean the mating elements may be placed in removable physical connection. In another exemplary embodiment, mating may mean that one element is configured to receive the other element in tight abutment.

Figure 10:
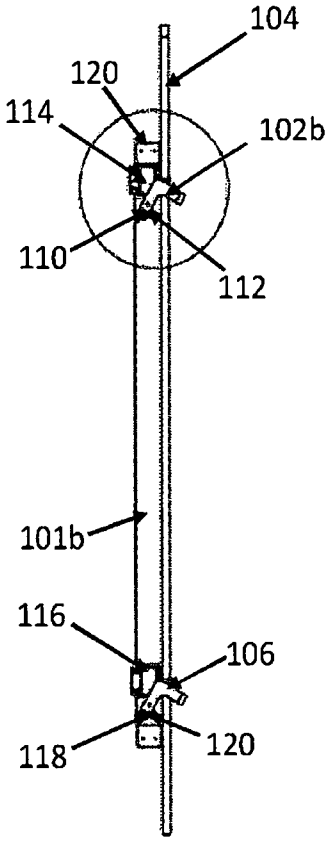
FIG. 10 is a side view illustrating an upper and lower locking bar affixed to a side bar according to an embodiment of the present invention.
Figure 9:
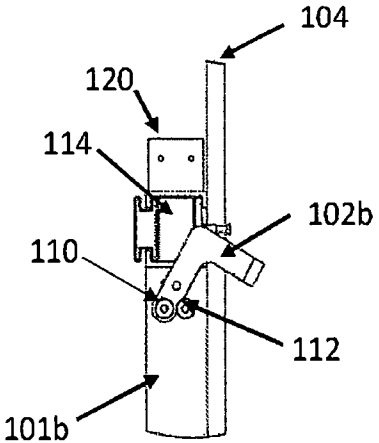
FIG. 9 is a side view illustrating locking bar affixed to a side bar according to an embodiment of the present invention.
Figure 8:
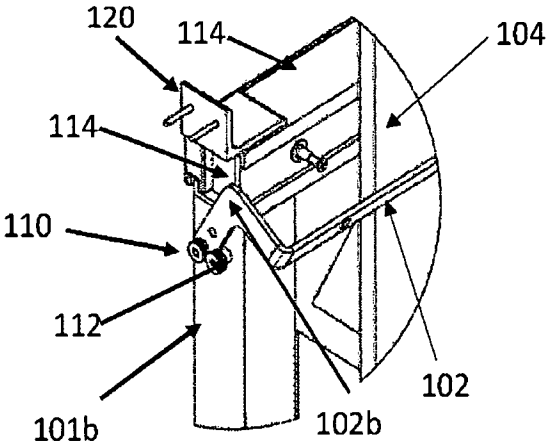
FIG. 8 is a perspective view illustrating locking bar affixed to a side bar according to an embodiment of the present invention.

FIGS. 8, and 9 illustrates an example of locking bar 102 rotatably affixed to side bar 101*b* at first end of side bar 101*b* using rotatably affixing means 110 according to the present invention. Particularly, FIG. 8 is a perspective view illustrating locking bar affixed to a side bar according to an embodiment of the present invention. FIG. 9 is a side view illustrating locking bar affixed to a side bar according to an embodiment of the present invention. FIG. 10 illustrates an example of locking bar 106 rotatably affixed to side bar 101*b* at second end of side bar 101*b* using rotatably affixing means 110 according to the present invention. As shown in FIGS. 8-10, the rotation of locking bar 102 (or locking bar 106) around rotatably affixing means 110 (or affixing means 118) may be restricted by an abutment 112 (or abutment 120). That is, abutment 112, 120 may be any material or construction that is included in frame 100 which ceases the angular rotation of locking bar 102. A suitable abutment 112, 120 may project from side bar 101*b* to abut against locking bar 102, 106 for stopping the angular rotation of locking bar 102, 106.

Figure 11:
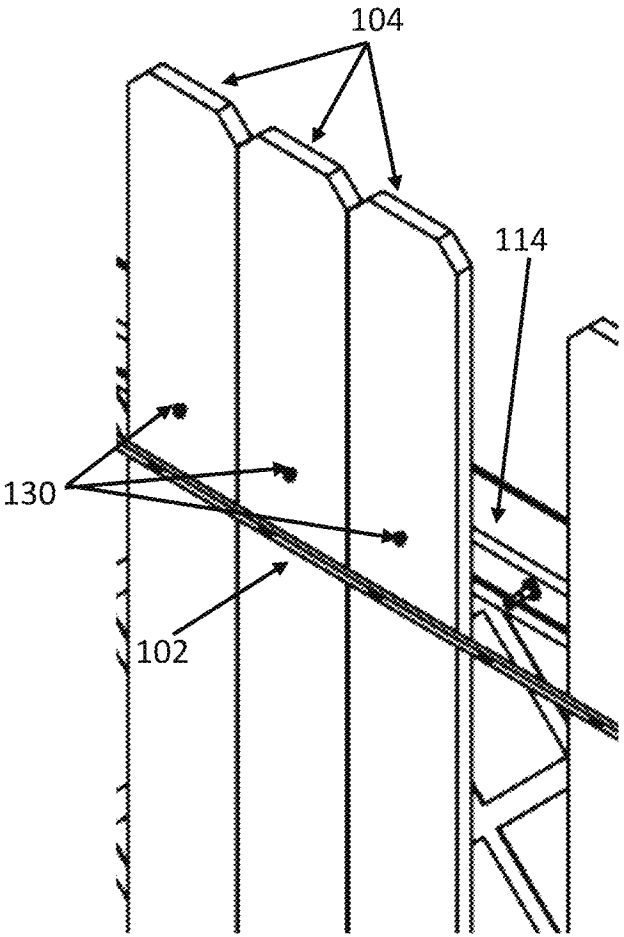
FIG. 11 is a perspective view of a portion of an exemplary embodiment of a fence board including mating holes on its lateral face according to an embodiment of the present invention.

As shown in FIG. 11, fence boards 104 may include one or more mating coupling holes 130 therethrough. Mating coupling holes 130 are formed in a lateral face of fence boards 104. In one exemplary embodiment, mating coupling holes 130 are formed completely through the fence boards 104 body. In another embodiment, mating coupling holes 130 form an aperture through the fence boards 104 from a lateral side. In still another exemplary embodiment, mating coupling holes 130 are formed in an upper portion of fence boards 104. In yet another embodiment, mating coupling holes 130 are formed in a lower portion of fence boards 104.

Figure 12:
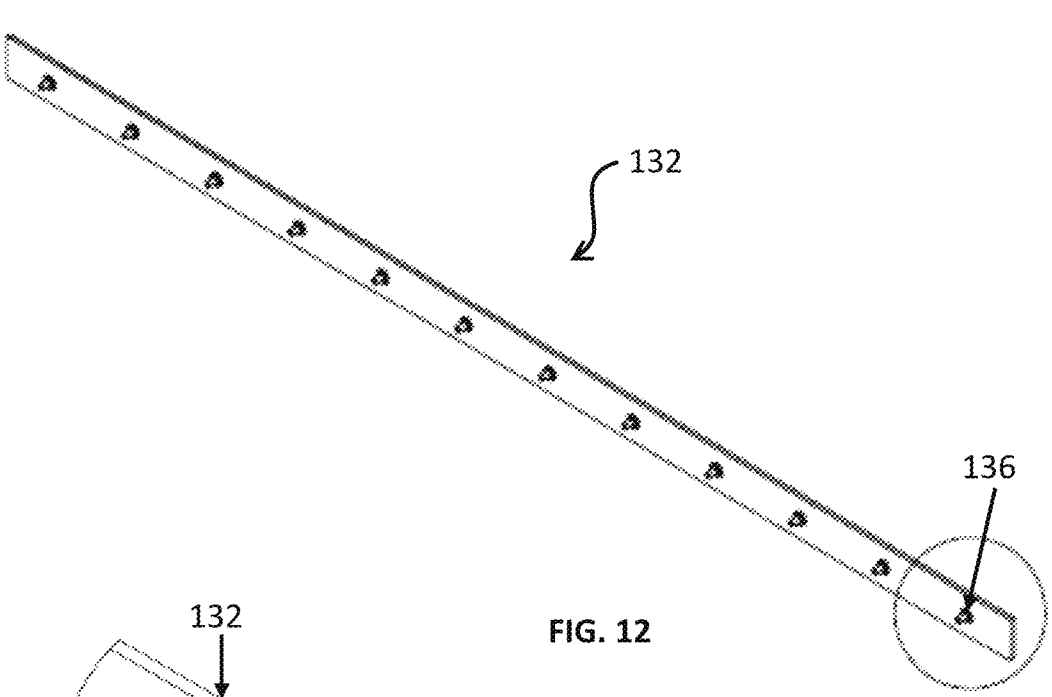
FIG. 12 is a perspective view of an exemplary depiction of the coupling bar according to an embodiment of the present invention.
Figure 14:
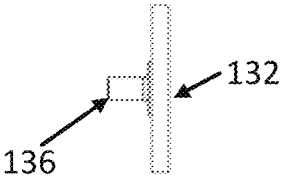
FIG. 14 is a side view of an exemplary depiction of the coupling bar according to an embodiment of the present invention.
Figure 13:
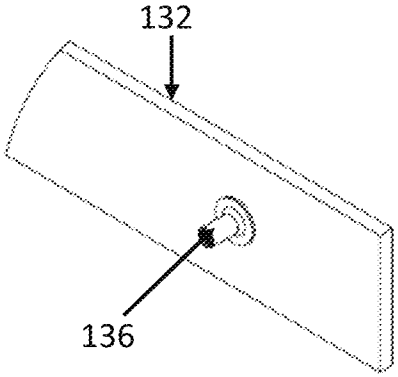
FIG. 13 is a perspective view of a portion of exemplary depiction of the coupling bar according to an embodiment of the present invention.
Figure 15:
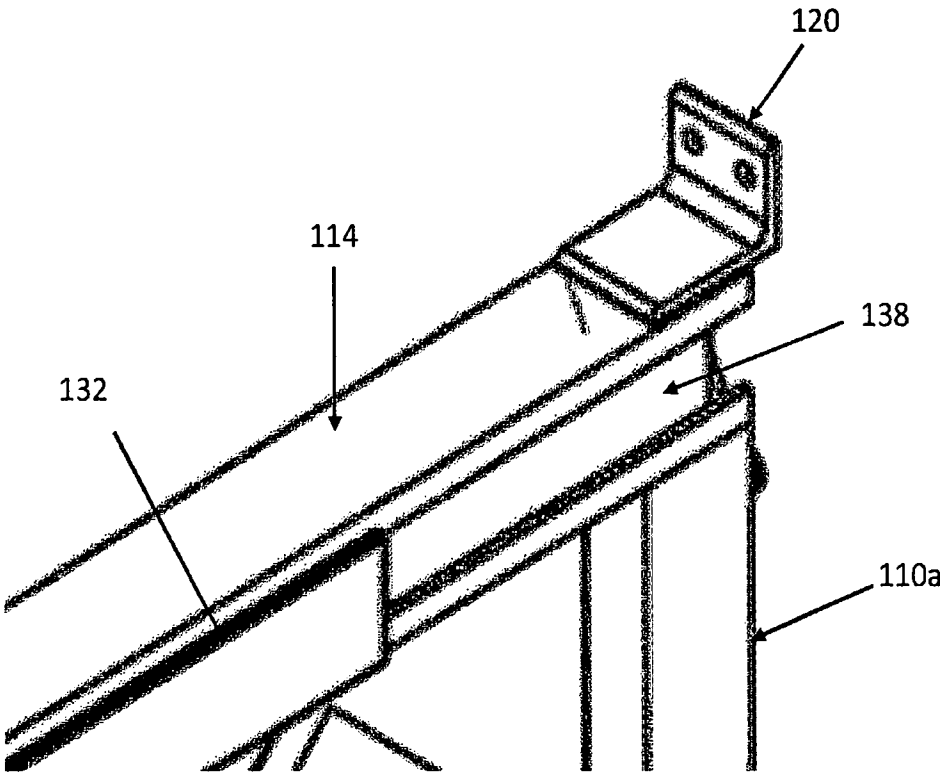
FIG. 15 is a perspective view illustrating a stationary bar recess configured to mate with a coupling bar according to an embodiment of the present invention.

Mating coupling holes 130 are used for coupling fence boards 104 to upper stationary bar 114 and lower stationary bar 116. FIGS. 12-14 depict a coupling peg bar 132 to which fence boards 104 may be affixed. Particularly, FIG. 12 is a perspective view of an exemplary depiction of the coupling bar according to an embodiment of the present invention. FIG. 13 is a perspective view of a portion of exemplary depiction of the coupling bar according to an embodiment of the present invention. FIG. 14 is a side view of an exemplary depiction of the coupling bar according to an embodiment of the present invention. Upper stationary bar 114 and lower stationary bar 116 may be constructed with a recess 138 (shown in FIG. 15) for accepting coupling peg bar 132. Recess 138 may progress along a longest edge of upper stationary bar 114 (or stationary bar 116). Recess 138 may be formed to mate with the edge of coupling peg bar 132.

With return reference now to FIGS. 12-14, coupling peg bar 132 may comprise a solid bar of suitable material having multiple evenly spaced mating pegs 136. Coupling peg bar 132 may include a single peg in alternate embodiments. Mating pegs 136 may project substantially perpendicular from a lateral side of coupling peg bar 132. In a preferred embodiment, mating pegs 136 are constructed to fit inside mating coupling holes 130. In another embodiment, mating pegs 136 progress at least partially through mating coupling holes 130. In yet another embodiment, mating pegs 136 progress substantially through mating coupling holes 130.

The present invention may use means for affixing fence boards 104 to coupling peg bar 132. For example, fence boards 104 may be place adjacent to coupling peg bar 132 such that mating pegs 136 progress into mating coupling holes 130. Then a fastener, such as a screw, nail, rivet of the like is placed into mating coupling holes 130. In one embodiment, the fastener may then removably affix with mating peg to assure a sure immovable affixing of fence boards 104 to coupling peg bar 132. By "removably join" what may be meant is that the fastener may be removed so that fence board 104 may be detached (e.g., "decoupled") from coupling peg bar 132. It should be noted, that fence board 104 are immovable when the fastener is fastened to mating peg 136, and is removable when the fastener is not joined with mating peg 136.

Once fence boards 104 are affixed to coupling peg bar 132, the user may desire to additionally secure the fence boards 104 in place. In such a case, upper locking bar 102 may be rotated in a position such that the locking bar is locked in a up position (e.g., closed position), wherein locking bar 102 is substantially abutting against abutment 112 as shown in FIG. 6. In this position, fence boards 104 may be removed from, detached from, coupling peg bar 132. In this way, fence boards 104 may be exchanged in the modular system 100 for newer fence boards 104.

Alternatively, a user may want to replace fence boards 104, such as when fence boards 104 become broken or worn out. For example, as shown in FIG. 7, locking bar 106 may be in a down position (e.g, the open position) wherein locking bar 106 is substantially abutting against abutment 112. To facilitate understanding of the invention, modular fence system 100 shown in FIGS. 8 and 9 is depicted with one fence board 104 not included and with upper locking bar 106 in an open position wherein locking bar 106 is not abutting against fence board 104 (e.g, the open position).

Figure 16:
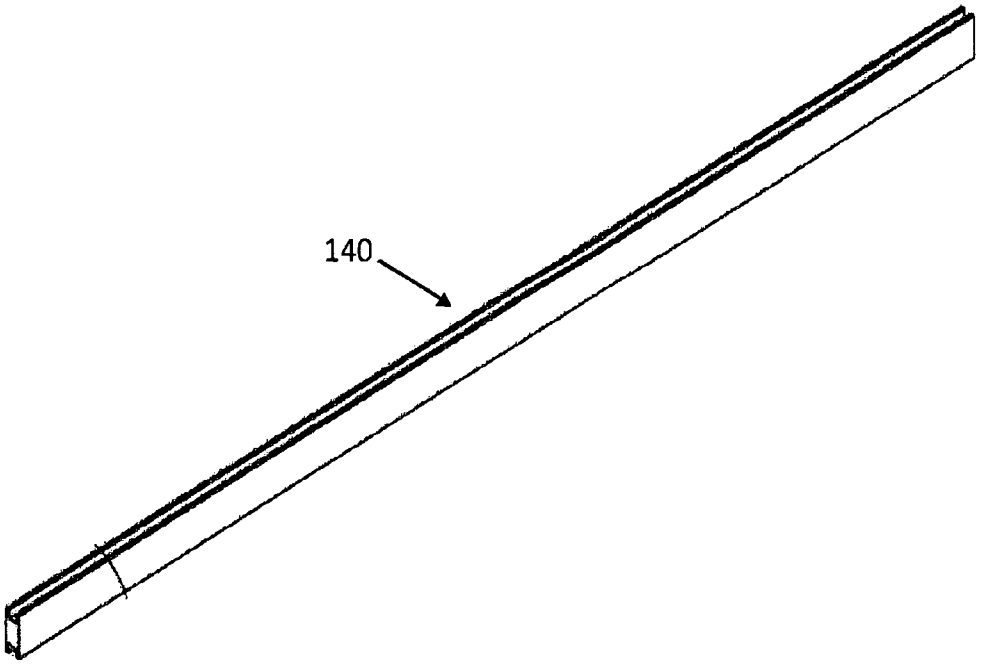
FIG. 16 is a perspective view of an exemplary depiction of a blank mating bar according to an embodiment of the present invention.
Figure 17:
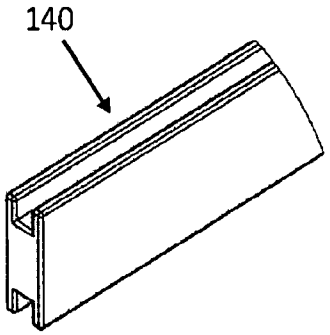
FIG. 17 is a perspective view of a portion of an exemplary depiction of a blank mating bar according to an embodiment of the present invention.
Figure 18:
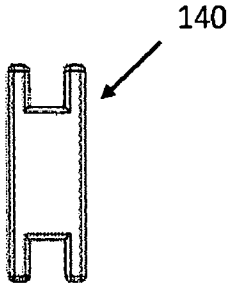
FIG. 18 is a perspective view of a portion of an exemplary depiction of a blank mating bar according to an embodiment of the present invention.
Figure 19:
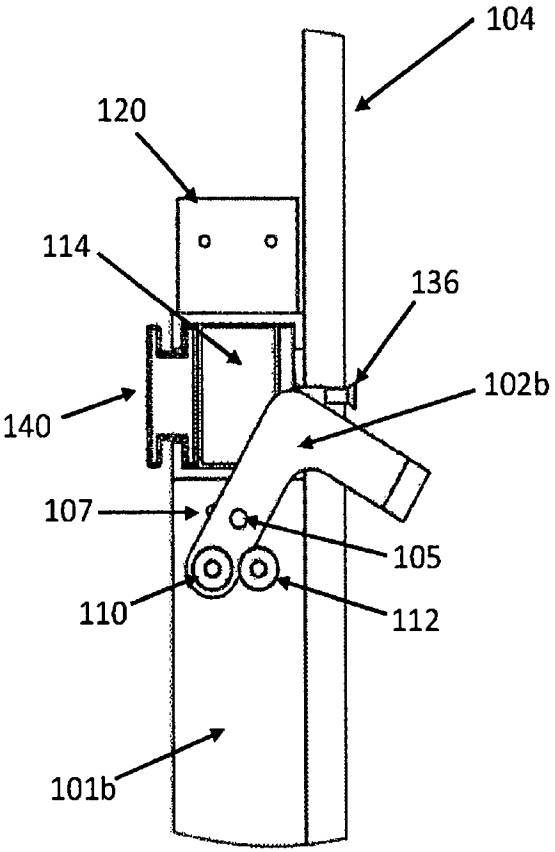
FIG. 19 is an exemplary depiction of a blank mating bar inserted into a stationary bar recess according an embodiment of the present invention.

It should be noted that upper stationary bar 114 or lower stationary bar 118) may be constructed with a recess 139 on the side opposite recess 138. Recess 139 may be of similar construction as recess 138 described above. In some instances, recess 139 may be constructed for mating with a blank mating rod 140, shown in FIG. 16 (depicting blank mating rod 140 in perspective view), FIG. 17 (depicting blank mating rod 140 in perspective view), and FIG. 18 (depicting blank mating rod 140 in frontal view). As shown, blank mating rod 140 may not include mating pegs. Blank mating rod 140 may be elongated. Moreover, at least one edge of blank mating rod 140 may mate with stationary bar 114 and/or stationary bar 118 for installation Blank mating rod 140 may be constructed of similar material as is described with regard to modular fence system 100. Blank mating rod 140 may be used when the user does not desire the side opposite the fence boards 104 to also include similar fence boards 104. In such an instance, the user need only insert blank mating rod 140 into recess 138 instead of coupling peg bar 132, as shown in FIG. 19.

Figure 20:
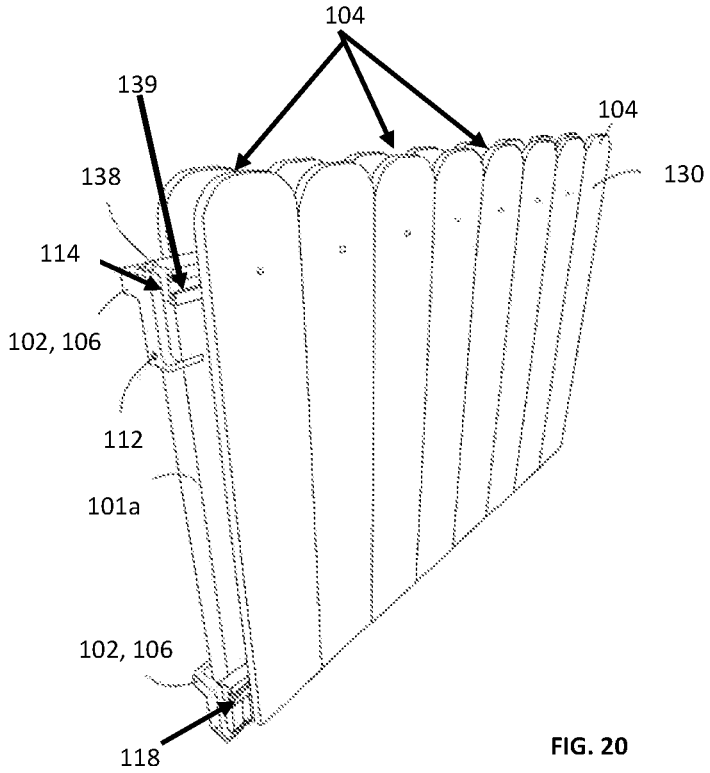
FIG. 20 is a perspective view of a double sided modular fence system according to various embodiments of the present invention.

Alternatively, the user may desire to include fence boards 104 on both sides of upper stationary bar 114 and lower stationary bar 118. Referring now to FIG. 20 showing an embodiment of a double-sided fence arrangement of the modular fence system 100 using lattice boarding as discussed below, wherein recess 138 and recess 139 each include a coupling peg bar for affixing fence boards 104 in similar manner as was discussed above. That is, upper stationary bar 114 and the lower stationary bar 118 may each include a recess 138 and a recess 139 formed in opposite sides of the stationary bars. Recesses 139 and 138 may be formed to allow installation of fence boards 104 on the opposite side of a single-sided fence arrangement having fences boards 104 on only one side.

In various other embodiments, the frame of the modular fence system 100 may be configured to mate with various other modular fence systems 100 to install a fences line or to make aesthetic both sides of the fence line. This can be accomplished by installing complete modular fence systems sections one to the other. That is, instead of including multiple fence boards 114, recess 138 or 139 may be configured to mate with a modular fence system 100

Figure 21:
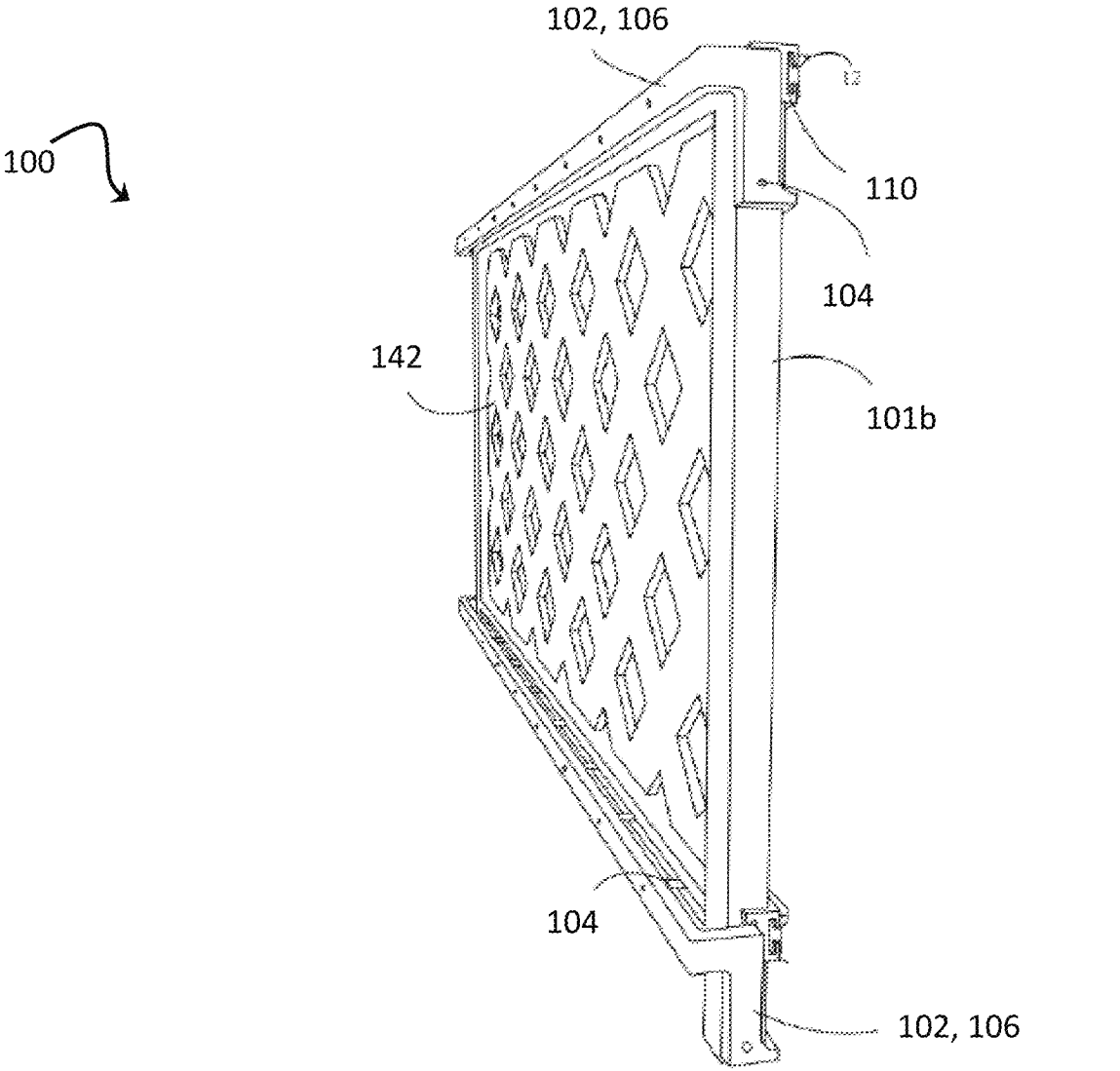
FIG. 21 is a perspective view of a modular fence system including a lattice shaped fence material according to various embodiments of the invention.

In another exemplary embodiment, modular fence system 100 may include a single decorative pane, such as a lattice pane entire modular fence systems 100 may be replaced in the fence line instead of fence boards 104. For example, instead of including a coupling peg bar 132 or a blank mating bar 140 in recess 138 and recess 139, modular fence system 100 may include a single pane of fence material 142 instead of fence boards 104. For example, fence material 142 may be lattice shaped such as that depicted in FIG. 21. Alternatively, fence material 142 may be configured including mating coupling holes in fence material 142 lateral surface, as was described with respect to coupling holes 130. Fence material 142 mating coupling holes may be configured to receive a fastener used to secure fence material 142 to coupling bar 132 as was described with respect to fence boards 104. In this way, fence material 142 may be removably affixed to coupling bar 132 in similar manner as was described with respect to fence boards 104.

Figure 23:
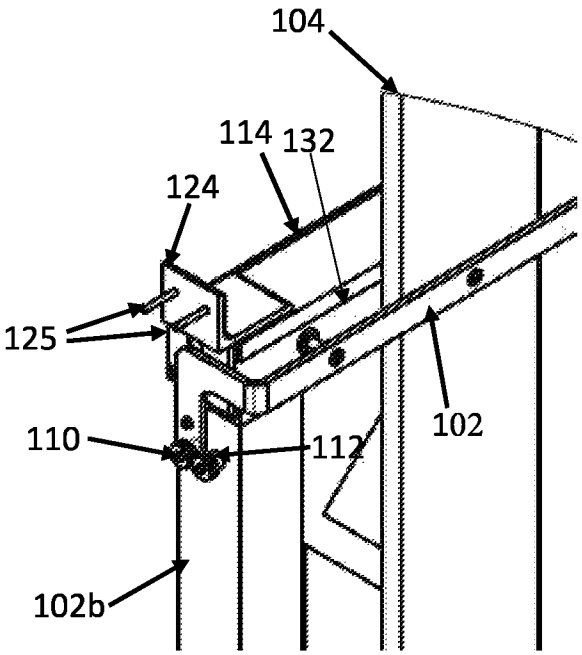
FIG. 23 depicts a modular fence coupler useful for joining multiple modular fence systems according to the present invention.
Figure 22:
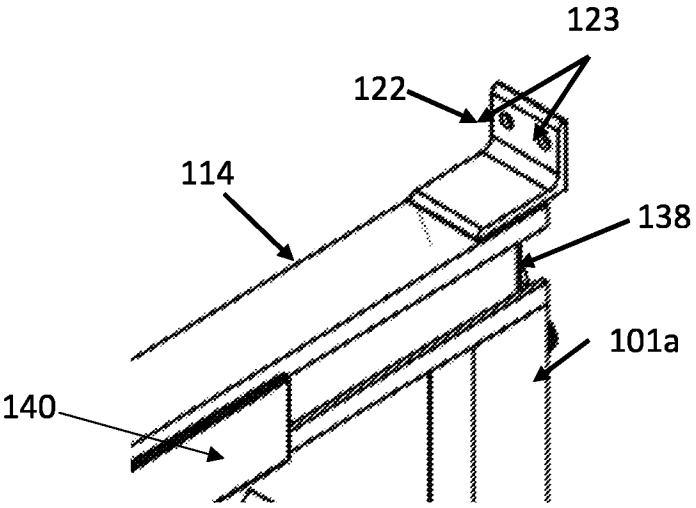
FIG. 22 depicts a modular fence coupler useful for joining multiple modular fence systems according to the present invention.

In some instances, a user may wish to join multiple modular fence systems 100 to form, for example, a fence line, such as, when enclosing a yard. Referring now to FIGS. 22 and 23, modular fence system 100 includes a first modular fence coupler 122 affixed to a first end of stationary bar 114, and a second modular fence coupler 124 affixed to a second distal end of stationary bar 114, wherein the first fence coupler 122 is configured to be removably affixed to second fence coupler 124. Particularly, FIG. 22 depicts a modular fence coupler useful for joining multiple modular fence systems according to the present invention. FIG. 23 depicts a modular fence coupler useful for joining multiple modular fence systems according to the present invention. For example, modular fence coupler 122 may include apertures 123 on one of its lateral surfaces, and modular fence coupler 124 may include post 125 projecting from one lateral its lateral surface wherein the modular fence coupler post 125 may be inserted into modular fence coupler apertures 123. In one exemplary embodiment, modular fence coupler post 125 may mate with modular fence coupler apertures 123. In yet another embodiment, modular fence coupler post 125 may be further secured, by for example, a faster attached to the modular fence coupler post 125 once the post is inserted into the modular fence coupler aperture 123, which may keep modular coupler post 125 from freely returning back through modular fence aperture 123. A typical fastener may be a nut, pin a ring, etc. When the modular fence coupler posts 125 are secured through modular fence coupler 125, a first modular fence may be affixed to another.

Figure 24:
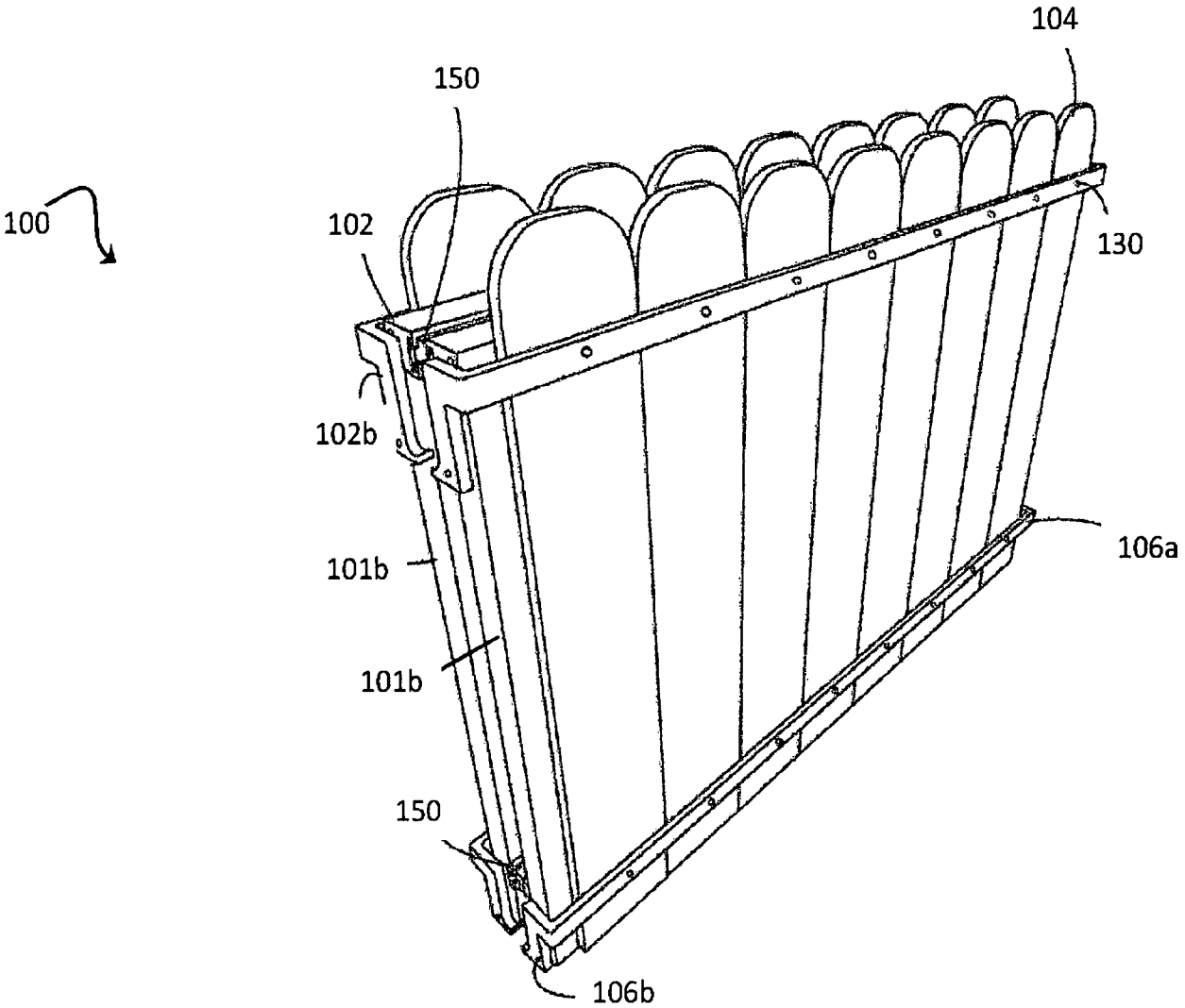
FIG. 24 depicts a perspective view of multiple modular fences affixed together according to an embodiment of the present invention.

In some instances, a user may wish to install modular fence systems 100 back to back. That is, at least two modular fence systems 100 are conjoined so that the modular fence system may appear on both sides of the fence line, as shown in FIG. 24. In this instance, multiple coupling peg bars 132 may be used to couple at least 2 modular fence systems 100 one to the other.

Figure 25:
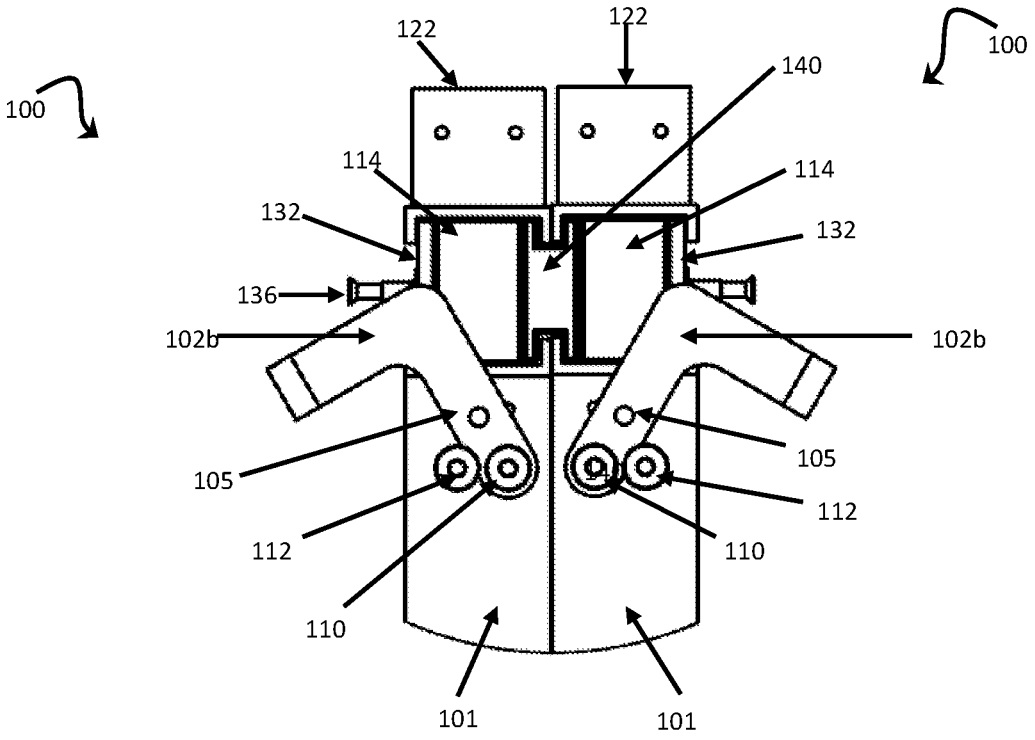
FIG. 25 depicts a lateral view of two modular fences affixed to each other according to various embodiments of the invention.

Referring now to FIG. 25, what is shown is two adjacent modular fence systems 100 as may occur in the embodiment shown in FIG. 24. Lower locking bars **102*b* are shown rotated downwards in an "open" position. As can be seen, each modular fence system 100 includes a coupling peg bar 132 to which fence boards 104 may be affixed. Each modular fence system 100 may be affixed to the other using blank mating rod 140. In this instance, instead of affixing, for example, a fence material 142 to recess 139, the user would affix a second module fence system 100. The affixing can be done by any method discussed above for affixing a fence material 142 to the modular fence system 100** frame.

In some instances, a user may wish to secure locking bar 102 to side bar **101*a*. For example, with return reference to FIGS. 3, locking bar second end 102*b* may include locking aperture 105. With reference to FIG. 19, a second end of side bar 101*b* may include a locking pin 107 configured to mate with locking aperture 105 when inserted therein. Locking pin 107 may be removable from the second end of side bar 101*b*. It may be any pin insertable in locking aperture 105. Locking pin 107** may be a conventional locking pin as is found in the art.

During operation, locking bar 102 may be rotated into the closed position, as shown in FIG. 6. Once locking bar 102 is rotated in the closed position, locking pin 107 may be inserted into locking aperture 105. In such an instance, the action of inserting locking pin 107 into locking aperture 105 locks locking bar 102 in a fixed closed position. To move the locking bar 102 into the open position, the user need only remove the locking pin 107 from aperture 105 and rotate the locking bar 102 down as shown in FIG. 7.

The exact specifications, materials used, and method of use of the modular fence system may vary upon manufacturing. However, it is contemplated that the material used be sturdy, rigid materials of the kind found in conventional fencing. For example, the material may be wood, metal, plastic, vinyl, bamboo, trex Dex materials etc. a combination thereof, or the like.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

What is claimed is:

1. A modular fence system comprising:

a. an elongated fence board, the elongated fence board having an upper portion, the elongated fence board including a mating coupling hole in the upper portion of the elongated fence board;

b. a coupling peg bar, the coupling peg bar having a first side, the coupling peg bar having a mating peg on the first side of the coupling peg board, the mating peg configured to mate with the mating coupling hole in the upper portion of the elongated fence board;

c. a first side bar, the first side bar having a first end; and d. a locking bar, the locking bar having a first end, wherein the first end of the locking bar is rotatably affixed to the first end of the first side bar, and wherein the locking bar immovably locks the upper portion of the elongated fence bar into abutment with the coupling peg bar when the locking bar is rotated in a closed position;

e. a stationary bar, wherein the stationary bar is configured to mate with a second side of the coupling peg bar, the stationary bar having a first end, and wherein the first end of the stationary bar is affixed to the first end of the first side bar;

f. a lower locking bar, the lower locking bar having a first end and a second end; and g. a second side bar, the second side bar having a first end and a second end, wherein the first end of the lower locking bar is rotatably affixed to the first end of the second side bar, wherein the locking bar includes a second end, wherein the second end of the locking bar is rotatably affixed to the second end of the second side bar, wherein the first side bar includes a second end, and wherein the second end of the lower locking bar is rotatably affixed to the second end of the first side bar.

2. A modular fence system according to claim 1 further comprising:

a. a lower stationary bar, the lower stationary bar having a first and second end, wherein the first end of the lower stationary bar is affixed to the first end of the second side bar, and wherein the second end of the lower stationary bar is affixed to the second end of the first side bar;

b. a lower coupling peg bar, the lower coupling peg bar having a first side, the lower coupling peg bar having a mating peg on the first side of the lower coupling peg bar, wherein the elongated fence board has a lower portion, wherein the lower portion of the elongated fence board includes a mating hole, wherein the mating hole of the lower portion of the elongated fence board is configured to mate with the mating peg of the first side of the lower coupling peg bar, wherein the lower coupling peg bar includes a second side, and wherein the lower stationary bar is configured to mate with the second side of the lower coupling peg bar.

3. A modular fence system according to claim 2, wherein the lower locking bar immovably locks the lower portion of the elongated fence bar into abutment with the lower coupling peg bar when the lower locking bar is rotated in a closed position.

4. A modular fence system according to claim 2, wherein the locking bar unlocks the upper portion of the elongated fence board when the locking bar is rotated in an open position, and wherein the lower locking bar unlocks the lower portion of the elongated fence board when the lower locking bar is rotated in an open position.

5. A modular fence system according to claim 4, wherein the stationary bar further comprises a second side, and wherein the lower stationary bar further comprises a second side.

6. A modular fence system according to claim 5, further comprising a third coupling peg bar, the third coupling peg bar having a first side, wherein the first side of the third coupling peg is configured to mate with the second side of the stationary bar, and wherein the third coupling peg bar includes a second side, wherein the second side of the third coupling peg bar includes a mating peg.

7. A modular fence system according to claim 6, further comprising a blank mating rod, the blank mating rod having a first side and a second side, the first side of the blank mating rod configured to mate with the second side of the stationary bar.

8. A modular fence system according to claim 7, further comprising a third stationary bar, the third stationary bar having a first side, the first side of the third stationary bar configured to mate-with the second side of the blank mating rod.

9. A modular fence system according to claim 1 further comprising a third side bar, the third side bar having a first end and a second end, wherein the first end of the third side bar is affixed to the first end of the second side bar, and wherein the second end of the third side bar is affixed to the second end of the second side bar.

10. A modular fence system comprising:

a. a stationary bar, the stationary bar having a first end and a second end, b. a first side bar, the first side bar having a first end, and wherein the first end of the stationary bar is affixed to the first end of the first side bar, c. a coupling peg bar, the coupling peg bar having a first side and a second side, the coupling peg bar having a mating peg on the first side of the coupling peg board; wherein the stationary bar is configured to mate with the second side of the coupling peg bar; and d. a locking bar, the locking bar having a first end, wherein the first end of the locking bar is rotatably affixed to the first end of the first side bar;

e. a lower locking bar, the lower locking bar having a first end and a second end;

f. a second side bar, the second side bar having a first end and a second end, wherein the first end of the lower locking bar is rotatably affixed to the first end of the second side bar, wherein the locking bar includes a second end, wherein the second end of the locking bar is rotatably affixed to the second end of the second side bar, wherein the first side bar includes a second end, and wherein the second end of the lower locking bar is rotatably affixed to the second end of the first side bar;

g. a lower stationary bar, the lower stationary bar having a first and second end, wherein the first end of the lower stationary bar is affixed to the first end of the second side bar, and wherein the second end of the lower stationary bar is affixed to the second end of the first side bar; and h. a lower coupling peg bar, the lower coupling peg bar having a first side, the lower coupling peg bar having a mating peg on the first side of the lower coupling peg bar, wherein the lower coupling peg bar includes a second side, and wherein the lower stationary bar is configured to mate with the second side of the lower coupling peg bar.

11. A modular fence system according to claim 10, wherein the stationary bar further comprises a second side, and wherein the lower stationary bar further comprises a second side.

12. A modular fence system according to claim 11, further comprising a third coupling peg bar, the third coupling peg bar having a first side, wherein the first side of the third coupling peg is configured to mate with the second side of the stationary bar, and wherein the third coupling peg bar includes a second side, wherein the second side of the third coupling peg bar includes a mating peg.

13. A modular fence system according to claim 11, further comprising a blank mating rod, the blank mating rod having a first side and a second side, the first side of the blank mating rod configured to mate with the second side of the stationary bar.

14. A modular fence system according to claim 13, further comprising a third stationary bar, the third stationary bar having a first side, the first side of the third stationary bar configured to mate with the second side of the blank mating rod.

15. A modular fence system according to claim 10 further comprising a third side bar, the third side bar having a first end and a second end, wherein the first end of the third side bar is affixed to the first end of the second side bar, and wherein the second end of the third side bar is affixed to the second end of the second side bar.

16. A modular fence system according to claim 15, wherein the lower locking bar immovably locks the lower portion of the elongated fence bar into abutment with the lower coupling peg bar when the lower locking bar is rotated in a closed position.

* * * * *